United States Patent [19]

Tikhova et al.

[11] 4,116,731

[45] Sep. 26, 1978

[54] HEAT TREATED AND AGED MAGNESIUM-BASE ALLOY

[76] Inventors: Nina Mikhailovna Tikhova, Frunzenskaya naberezhnaya, 38/1, kv. 394; Valentina Alexeevna Blokhina, 15 Parkovaya ulitsa, 42, korpus 3, kv. 25; Antonina Petrovna Antipova, Sheremetievskaya ulitsa, 71a, kv. 19; Tamara Pavlovna Vasilieva, Izmailovsky bulvar, 46, kv. 5, all of Moscow, U.S.S.R.

[21] Appl. No.: 819,566

[22] Filed: Jul. 27, 1977

Related U.S. Application Data

[63] Continuation-in-part of Ser. No. 718,872, Aug. 30, 1976, abandoned, which is a continuation of Ser. No. 515,024, Oct. 15, 1974, abandoned, which is a continuation of Ser. No. 340,749, Mar. 13, 1973, abandoned.

[51] Int. Cl.[2] ..... C22F 1/06

[52] U.S. Cl. ..... 148/161; 75/168 R; 75/168 D; 75/168 E; 75/168 J; 148/32.5

[58] Field of Search ..... 75/168 R, 168 D, 168 E, 75/168 J; 148/161, 32.5

[56] References Cited

U.S. PATENT DOCUMENTS

| | | | |
|---|---|---|---|
| 3,039,868 | 6/1962 | Payne et al. | 75/168 J |
| 3,092,492 | 6/1963 | Foerster | 75/168 J |
| 3,157,496 | 11/1964 | Foerster | 75/168 R |
| 3,419,385 | 12/1968 | Foerster et al. | 75/168 R |

FOREIGN PATENT DOCUMENTS

| | | | |
|---|---|---|---|
| 1,067,915 | 5/1967 | United Kingdom | 75/168 J |
| 287,309 | 1/1971 | U.S.S.R. | 75/168 J |

*Primary Examiner*—M. J. Andrews
*Attorney, Agent, or Firm*—Holman & Stern

[57] ABSTRACT

A magnesium-based alloy is proposed which can be used for manufacturing various parts by casting. The alloy is highly heat-resistant and has good mechanical properties both at room temperature and at temperatures up to 300° C. The parts manufactured from the proposed alloy can operate even at 400° C for a short period of time. The alloy contains from 0.8 to 6 wt.% yttrium, from 0.5 to 4 wt.% neodymium, from 0.1 to 2.2 wt.% zinc, from 0.31 to 1.1 wt.% zirconium, up to 0.05 wt.% copper, and up to 0.2 wt.% manganese, the rest being magnesium, on condition that no less than 50% of the total amount of yttrium and neodymium additions enters the solid solution after thermal treatment.

4 Claims, No Drawings

HEAT TREATED AND AGED MAGNESIUM-BASE ALLOY

CROSS-REFERENCES TO RELATED APPLICATIONS

The present is a continuation-in-part application of Ser. No. 718,872 filed Aug. 30, 1976, which in turn is a continuation of application Ser. No. 515,024 filed Oct. 15, 1974, which in turn is a continuation of application Ser. No. 340,749 filed Mar. 13, 1973, all now abandoned.

BACKGROUND OF THE INVENTION

The present invention relates to magnesium-based alloys and more particularly to light structural alloys which can be used for manufacturing parts of various constructions when the most important requirements imposed on the items are their light weight, rigidity, and high strength at temperatures of up to 300° C upon prolonged operation and up to 400° C upon short-term service.

Known in the art are numerous magnesium-based alloys with various alloying additives, the choice of such additives being dependent on the requirements imposed on the alloy, since some additives ensure high heat-resistance and others high strength at room temperature.

However, as will be shown below in greater detail all industrial magnesium-based alloys known at present, not containing a radioactive additive of thorium, are applied, as a rule, at temperatures not exceeding 200°–250° C at best.

For example, known in the art are high-strength alloys AZ-92, AZ-91, and ZK-61 having tensile strength of 27–30 kg/mm$^2$. But these alloys are not heat-resistant, since above 150° C their mechanical properties deteriorate drastically. The alloy QE-22 is another heat-resistant alloy which, due to its good mechanical properties, can be used for manufacturing parts which operate at 200° – 250° C for a long period of time and at 300° – 350° C for short intervals.

Also known in the art is a magnesium-based alloy containing 0.1 – 10 wt. % yttrium, 0.1 – 10 wt. % zirconium, up to 1.25 wt. % zinc, 0.15 – 0.5 wt. % manganese, and up to 3.0 wt. % are rare-earths; the rest is magnesium. The alloy is described in Belgian Pat. No. 654,809. However, poor mechanical properties at 20° C (yield strength 7.2 kg/mm$^2$) and low heat-resistance limit the application of this alloy at temperatures up to 150° C under conditions of prolonged load.

Another alloy, which is more heat-resistant, is described in U.S. Pat. No. 3,157,496. The alloy contains, in addition to magnesium, 0.05 – 0.5 wt. % zinc and 0.05 – 2.0 wt. % of a rare-earth element. However, creep limit of the alloy at 205° C is 3.5 kg/mm$^2$, which makes the alloy unsuitable for manufacturing parts operating at temperatures above 200° C.

Various attempts were made to increase the yield point in compression by means of enhancing the zinc content. Thus, for example, in U.S. Pat. No. 3,183,083 a magnesium-based alloy is described which contains 7 – 16 wt. % zinc, 0.1–1.0 wt. % zirconium and 1 – 8 wt. % of a rare-earth element. In addition, a possibility is considered of introducing rare-earth metals into the alloy from a mischmetal.

It should also be noted that alloys with such a high zinc content have low heat-resistance. Likewise known in the art is an alloy for manufacturing pressed half-finished products (see U.S. Pat. No. 2,549,955), containing no less than 85 wt. % magnesium, 0.4 wt. % zirconium, and from 0.5 to 4.0 wt. % rare-earth metals, including neodymium, cerium and lanthanum. But it is known that alloys containing cerium and lanthanum have poor mechanical properties at room temperature and are intended for operation at temperatures up to 250° C.

All of the above-cited alloys are intended for manufacturing articles by pressing, forging, stamping, and by other similar techniques and have relatively low heat-resistance. Therefore, such alloys did not find application for casting shaped parts operating at high temperatures.

Widely known are heat-resistant magnesium-based alloys containing thorium. For example, the alloy HK-31 contains in wt. %: from 2.5 to 4.0 thorium, from 0.4 to 1,0 zirconium, no less than 0.3 zinc, magnesium being the rest; the alloy HZ-32 contains in wt. %: from 2.5 to 4.0 thorium, from 0.5 to 1.0 zirconium, from 1.7 to 2.5 zinc, magnesium being the rest. However, the production of these alloys involves radiation hazards for the attending personnel because of the radiological toxicity of thorium, and calls for special protection.

SUMMARY OF THE INVENTION

It is the main object of the invention to provide a magnesium-based alloy with high mechanical properties at room temperature and considerably more heat-resistant than hitherto known magnesium-based alloys not containing thorium.

Another object of the invention is to provide an alloy which can be used for manufacturing cast shaped parts, for example, those for aircraft, operating at high temperatures and loads.

Among other objects is the provision of an alloy with a fine-grained structure, castings from which are noted for high tightness.

A further object of the invention is to provide an alloy ensuring stable dimensions of parts manufactured therefrom during operation and uniform properties of the parts in any section.

The above-cited and other objects of the invention are accomplished by the provision of an alloy comprising, essentially, the following components (in wt. %):

yttrium, from 0.8 to 6.0
neodymium, from 0.5 to 4.0
zinc, from 0.1 to 2.2
zirconium, from 0.31 to 1.1
copper, up to 0.05
manganese, up to 0.2
magnesium, the rest, on condition that no less than 50% of the total amount of neodymium and yttrium additions enters solid solution after heat treatment.

Yttrium, neodymium, and zinc present in the alloy ensure a favorable combination of high heat-resistance with high mechanical properties at room temperature due to the alloyed solid solution and the formation of intermetallic phases with enhanced thermal stability.

The use of zirconium, which is an effective grain breaker as one of the alloying elements improves not only the mechanical properties under short-term stretching but the technological casting properties of the alloy as well.

The presence of yttrium, neodymium, zinc, and zirconium in the above-cited ratio considerably increases heat-resistance of the alloy, approximately by 100° C, as can be seen from Table 2 given hereinbelow by way of illustration.

A decrease in the component content with respect to the given above reduces heat-resistance of the alloy.

An increase in the content of these components decreases the plasticity of the alloy. In particular, a rise in zinc content in the alloy, when yttrium, neodymium, and zirconium are present, reduces sharply the heat resistance and mechanical properties at room and elevated temperatures.

DETAILED DESCRIPTION OF PREFERRED EMBODIMENTS

For a better understanding of the present invention specific examples of preparing a magnesium-based alloy according to the invention are given hereinbelow by way of illustration.

EXAMPLE 1

For preparing the alloy, electric furnaces with removable steel crucibles having a capacity up to 50 kg were used.

Into a pre-heated crucible a charge with the following content of the components were placed:

zinc: 150 g
magnesium: 40,950 g and master alloys containing magnesium-zirconium 2,500 g; magnesium-neodymium, 3,200 g; and magnesium-yttrium, 3,200 g; 97%-pure yttrium and neodymium were used for preparing the master alloys.

After melting the charge at 760°–780° C, zinc and the magnesium-neodymium master alloy were introduced. After melting the magnesium-neodymium master alloy, the magnesium-zirconium master alloy was added portion-wise into the melt and the latter was carefully stirred for 3–5 minutes. Then at 750°–770° C the magnesium-yttrium master alloy was introduced and the melt was refined. Keeping before pouring was no less than 10 minutes. The melt obtained was poured into molds at 730°–740° C. The prepared alloy contained in wt.%:

yttrium, 1.4
neodymium, 1.6
zinc, 0.15
zirconium, 0.6
magnesium, the rest.

The alloy obtained was heat treated.

Heat treatment consists of two operations: hardening for dissolving excess phases in the solid solution at 535° C±5° C for 4–8 hours and cooling in a stream of air; ageing at 200° C±5° C for 12 hours. After such treatment no less than 50% neodymium and yttrium enter the solid solution.

After the above-cited heat treatment, the alloy had the following mechanical properties at 20° C and at 300° C:

yield limit ($\sigma_{0,2}^{20°}$) 12 kg/mm$^2$,
ultimate strength ($\sigma_B^{20°}$) 26 kg/mm$^2$,
relative elongation ($\delta_5^{20°}$) 6%,
long-term strength at elevated temperatures ($\sigma_{100}^{300°}$) 6 kg/mm$^2$,
creep limit ($\sigma_{0.2/100}^{t°C}$) at elevated temperatures.

EXAMPLE 2

The equipment technology of production of magnesium-based alloy, and heat treatment according to the invention were similar to those described in Example 1.

The following components were taken for preparing the alloy:

magnesium, 37,800 g;
zinc, 300 g;
master alloys containing magnesium-zirconium, 2,500 g;
magnesium-neodymium, 4,600 g;
magnesium-yttrium, 4,800 g.

The obtained alloy contained in wt. %:

yttrium, 2.2;
neodymium, 2.8;
zirconium, 0.8;
zinc, 0.6;
magnesium, the rest.

Mechanical properties of the alloy at 20° C and at elevated temperatures were as follows:

$\sigma_{0.2}^{20°} = 15$ kg/mm$^2$,
$\sigma_B^{20°} = 28$–$30$ kg/mm$^2$,
$\delta_5^{20°} = 4\%$
$\sigma_{100}^{200°} = 18$ kg/mm$^2$,
$\sigma_{0.2/100}^{200°} = 11.5$ kg/mm$^2$,
$\sigma_{100}^{250°} = 11.5$–$13$ kg/mm$^2$,
$\sigma_{0.2/100}^{250°} = 7.5$–$8.5$ kg/mm$^2$,
$\sigma_{100}^{300°} = 6$–$6.5$ kg/mm$^2$.

EXAMPLE 3

The equipment technology, and thermal treatment were similar to those described in Example 1. The following components were taken for preparing the alloy:

magnesium, 38,350 g,
zinc, 1,000 g,
master alloys containing:

magnesium-zirconium, 1,250 g;
magnesium-neodymium, 1,000 g;
magnesium-yttrium, 8,400 g.

The obtained alloy contained in wt. %:

yttrium, 6.0;
neodymium, 0.5;
zinc, 2.2;
zirconium, 0.31;
magnesium, the rest.

Mechanical properties of the alloy at 20° C and at 300° C were as follows:

$\sigma_{0.2}^{20°} = 11$ kg/mm$^2$,
$\sigma_B^{20°} = 23$ kg/mm$^2$,
$\delta_5^{20°} = 3$–$6$ %,
$\sigma_{100}^{300°} = 6$–$7$ kg/mm$^2$ For experimental purposes the inventors prepared alloys containing, instead of neodymium, cerium mischmetal and didymium (neodymium with praseodymium), with the ratio between the other components being the same. The alloys were prepared and heat treated by following the procedure described in Example 1.

Mechanical properties of the alloys after heat treatment are given in Table 1.

Table 1*

| | 20° C | | | 300° C Time before destruction, hrs |
|---|---|---|---|---|
| | kg/mm² $\sigma_{0.2}$ | kg/mm² $\sigma_B$ | δ% | at $\sigma$ = 6 kg/ /mm² |
| Composition of alloy according to the invention, obtained by following the procedure described in Example 1 | 18.0 | 28.0 | 5.0 | 150<br>160 |
| alloys with the use of cerium mischmetal | 11.0 | 18.0 | 7.0 | 52<br>63 |
| alloy with the use of didymium | 15.0 | 26.0 | 3.0 | 109<br>95 |

*Tests were conducted on a machine ZD4 (GDR); yield point was obtained from the chart.

As is clear from Table 1, the replacement of neodymium used in the alloy proposed by cerium mischmetal deteriorates drastically the properties at room temperature and weakens the strength at 300° C. Introduction of didymium instead of neodymium decreases heat-resistance, since the time interval before the destruction of samples at 300° C and $\sigma$ = 6 kg/mm² becomes 1.5 times shorter.

Table 2 contains comparative data on the properties of the alloy obtained according to the invention and some other alloys.

The magnesium-based alloy proposed is more heat-resistant than all other alloys known at present; at the same time it is highly strong and has good technological properties.

Parts manufactured from such alloy are tight and have uniform mechanical properties in different sections.

The proposed alloy can be successfully used for manufacturing cast parts subject to heating during prolonged operation up to 300° and up to 400° C in the event of short-term service.

The use of the proposed alloy instead of aluminium alloys and in a number of cases instead of titanium alloys decrease considerably the weight of the parts.

Table 2

| | Chemical composition of alloys, % | | | | | | | | Mechanical properties of the alloys cited in Patents Temperature 20° C | | | | |
|---|---|---|---|---|---|---|---|---|---|---|---|---|---|
| Alloy 1 | Y 2 | Nd 3 | Zn 4 | Zr 5 | Cu 6 | Mn 7 | Rare earth metals 8 | Didyum (Nd+Pr) 9 | $\sigma_B$ kg/mm² 10 | $\sigma_{0.2}$ kg/mm² 11 | δ% 12 | Elevated temperatures 13 | Notes 14 |
| Alloy according to the invention | 0.8–6.0 | 0.5–4.0 | 0.1–2.2 | 0.31–1.1 | up to 0.05 | up to 0.2 | — | — | 28–30 | 15 | 4 | $\sigma_{100}^{300}$ on the level of 6–6.5 kg/mm²<br>$\sigma_{0.2/100}^{300}$ on the level of 3.5 kg/mm²<br>$\sigma_{0.2/100}^{250}$ on the level of 7.5–8.5 kg/mm²<br>$\sigma_B^{450}$ on the level of 5 kg/mm² | Heat-resistant casting magnesium-based alloy |
| Alloy according to Pat. No. 654,809 | 0.1–10 | — | up to 1.25 | 0.1–1.0 | — | 0.15–0.5 | up to 3 | — | not cited | | | | The alloys proposed in the Patents have decreased oxidability and enhanced mechanical properties as compared with binary alloys Mg - 0.7% Zr |
| | 0.9 | — | — | 0.7 | — | — | — | — | 18.2 | 7.2 | 20 | $\sigma_B^{450}$= 1.2 kg/mm²<br>$\sigma_{0.2}^{450}$= 1.0 kg/mm² | |
| Alloy according to Pat. No. 3,157,496 | — | — | 0.5–5.0 | No more than 0.2 | — | 0.2–2.0 | 0.05–2.0 | — | not given | | | | Given are the properties of rolled half-finished products, sheets, pressed material |
| | — | — | 0.1–1.3 | — | — | up to 1.0 | mm[x] 0.2–0.4 | — | — | 11.2–18.2 | 10–22 | $\sigma_{0.2/100}^{205}$= 3.5 kg/mm² | |
| Alloy according to Pat. No. 3,183,083 | — | — | 7–16 | 0.1–1.0 | — | — | 1.0—8 | — | not given | | | | Pressed material. Given is yield point in compression as a function of force and rate of pressing |
| | | | 9.0 | — | — | — | mm[x] 2.0 | | | | | $\sigma_{0.2}$= 25.2–33.6 kg/mm² | |
| Alloy according to Pat. No. 2,549,959 | — | — | — | 0.4 | — | — | 0.5–4.0 | | | | | | |
| | — | — | 2.5 | 0.7 | — | — | — | 2.5 | 18.0 | 8.5 | 9 | | |
| | — | — | 2.5 | 0.7 | — | — | — | 2.0 | 21.0 | 12.6 | 5 | | |

*mm - cerium mishmetal.

As is seen from the Table, the alloy according to the invention has ultimate strength at room temperature by 8 – 10 kg/mm² higher and creep limit considerably higher than all other alloys according to the above-cited Patents.

We claim:

1. A heat-treated and aged magnesium-based alloy, possessing heat-resistance and castability, suitable for manufacturing parts operating for a long time at temperatures up to 300° C and for a short period of time at 400° C, said alloy consisting essentially of, by weight: 0.8–6.0% yttrium, 0.5–4% neodymium, 0.1–2.2% zinc, 0.31–1.1% zirconium, up to 0.05% copper, up to 0.2% manganese and the balance being magnesium, provided that no less than 50% of the total amount of neodymium and yttrium additions enters the solid solution after heat treatment, the alloy having been heated at approximately 535° C for 4–8 hours, cooled in air and then aged at approximately 200° C for 12 hours.

2. The heat-treated and aged magnesium-based alloy of claim 1, consisting essentially of, by weight: 1.4% yttrium, 1.6% neodymium, 0.15% zinc, 0.6% zirconium and the balance being magnesium.

3. The heat-treated and aged magnesium-based alloy of claim 1, consisting essentially of, by weight: 2.2% yttrium, 2.8% neodymium, 0.6% zinc, 0.8% zirconium and the balance being magnesium.

4. The heat-treated and aged magnesium-based alloy of claim 1, consisting essentially of, by weight: 6.0% yttrium, 0.5% neodymium, 2.2% zinc, 0.31% zirconium and the balance being magnesium.

* * * * *